US011600229B2

(12) United States Patent
Kim et al.

(10) Patent No.: US 11,600,229 B2
(45) Date of Patent: Mar. 7, 2023

(54) PIXEL AND ORGANIC LIGHT EMITTING DIODE DISPLAY DEVICE

(71) Applicant: Samsung Display Co., Ltd., Yongin-Si (KR)

(72) Inventors: Hanbit Kim, Seoul (KR); Meejae Kang, Suwon-si (KR); Keunwoo Kim, Seongnam-si (KR); Doo-Na Kim, Seongnam-si (KR); Sangsub Kim, Suwon-si (KR); Dokyeong Lee, Yongin-si (KR); Jaehwan Chu, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/684,227

(22) Filed: Mar. 1, 2022

(65) Prior Publication Data

US 2022/0415255 A1 Dec. 29, 2022

(30) Foreign Application Priority Data

Jun. 25, 2021 (KR) ..... 10-2021-0083422

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/08* (2013.01); *G09G 2320/0214* (2013.01); *G09G 2330/021* (2013.01); *G09G 2340/0435* (2013.01)

(58) Field of Classification Search
None
See application file for complete search history.

(56) References Cited

U.S. PATENT DOCUMENTS

| | | | | |
|---|---|---|---|---|
| 10,380,940 | B2 * | 8/2019 | Lee | G09G 3/3233 |
| 2011/0157126 | A1 * | 6/2011 | Chung | G09G 3/3233 345/76 |
| 2011/0157144 | A1 * | 6/2011 | Park | G09G 3/3233 345/212 |

(Continued)

FOREIGN PATENT DOCUMENTS

| | | | |
|---|---|---|---|
| KR | 10-0490041 | B1 | 7/1999 |
| KR | 10-0485531 | B1 | 10/2003 |
| KR | 10-1647160 | B1 | 6/2013 |

*Primary Examiner* — Dorothy Harris
(74) *Attorney, Agent, or Firm* — Innovation Counsel LLP

(57) ABSTRACT

A pixel includes a first capacitor connected between a first electrode and a second electrode connected to a first node, a first transistor including a gate electrode connected to the first node, a first electrode connected to a second node, and a second electrode connected to a third node, a second transistor including a gate electrode that receives a data write gate signal, a first electrode that receives a data voltage, and a second electrode connected to the second node, a third transistor connected between the first node and the third node, a fourth transistor connected between the first node and an initialization voltage input terminal to which an initialization voltage is applied, an eighth transistor t connected to the third transistor and the fourth transistor, and an organic light emitting diode including an anode and a cathode receiving a second power supply voltage.

18 Claims, 8 Drawing Sheets

(56) References Cited

U.S. PATENT DOCUMENTS

| | | | | |
|---|---|---|---|---|
| 2012/0019501 | A1* | 1/2012 | Choi | G09G 3/3233 345/76 |
| 2017/0148379 | A1* | 5/2017 | Cho | G09G 3/3233 |
| 2018/0151115 | A1* | 5/2018 | Tseng | G09G 3/3233 |
| 2021/0074217 | A1* | 3/2021 | Lee | G09G 3/3233 |
| 2021/0375201 | A1* | 12/2021 | Park | G09G 3/3225 |

* cited by examiner

PIXEL AND ORGANIC LIGHT EMITTING DIODE DISPLAY DEVICE

CROSS-REFERENCE TO RELATED APPLICATION

This application claims priority under 35 USC § 119 to Korean Patent Application No. 10-2021-0083422 filed on Jun. 25, 2021, in the Korean Intellectual Property Office (KIPO), the entire disclosure of which is incorporated herein by reference.

BACKGROUND

1. Field

The present disclosure relates to a display device. More particularly, the present disclosure relates to a pixel of an organic light emitting diode display device and the organic light emitting diode display device.

2. Description of the Related Art

Organic light emitting diode display devices used in portable terminals such as smartphones and tablet computers are required to reduce their power consumption. Recently, in order to reduce the power consumption of the organic light emitting diode display device, a low-frequency driving technique of reducing a driving frequency when the organic light emitting diode display device displays a still image has been developed.

However, while a display panel displays an image based on data signals, the stored data signals may be distorted by leakage currents of transistors included in pixels of the display panel, and the like, and image quality of the organic light emitting diode display device may deteriorate.

SUMMARY

An object of the present disclosure is to provide a pixel capable of preventing or reducing deterioration of image quality during low-frequency driving.

Another object of the present disclosure is to provide an organic light emitting diode display device capable of preventing or reducing deterioration of image quality during low-frequency driving.

According to embodiments, a pixel may include a first capacitor including a first electrode to which a first power supply voltage is applied and a second electrode connected to a first node, a first transistor including a gate electrode connected to the first node, a first electrode connected to a second node, and a second electrode connected to a third node, a second transistor including a gate electrode to which a data write gate signal is applied, a first electrode to which a data voltage is applied, and a second electrode connected to the second node, a third transistor connected between the first node and the third node, and configured to diode-connect the first transistor in response to the data write gate signal, a fourth transistor connected between the first node and an initialization voltage input terminal to which an initialization voltage is applied, and configured to transmit the initialization voltage to the first node in response to a data initialization gate signal, an eighth transistor connected to the third transistor and the fourth transistor, and configured to control a current flowing through the third transistor and a current flowing through the fourth transistor in response to an emission bias signal, and an organic light emitting diode including an anode electrode and a cathode electrode to which a second power supply voltage is applied.

In embodiments, the third transistor may include a first sub-transistor and a second sub-transistor which are connected in series between the first node and the third node. In addition, the fourth transistor may include a third sub-transistor and a fourth sub-transistor which are connected in series between the first node and the initialization voltage input terminal. Further, the eighth transistor may include a gate electrode to which the emission bias signal is applied, a first electrode connected to a third transistor node disposed between the first sub-transistor and the second sub-transistor, and a second electrode connected to a fourth transistor node disposed between the third sub-transistor and the fourth sub-transistor.

In embodiments, the eighth transistor may control the current flowing through the third transistor and the current flowing through the fourth transistor in response to the emission bias signal when the pixel is driven at a first frequency. In addition, the eighth transistor may be turned off when the pixel is driven at a second frequency higher than the first frequency.

In embodiments, the first frequency may be greater than 0 Hz and less than 60 Hz, and the second frequency may be greater than or equal to 60 Hz.

In embodiments, when the pixel is driven at the first frequency, the emission bias signal may have a low logic level during an emission period of the pixel and may have a high logic level during a non-emission period of the pixel.

In embodiments, when the emission bias signal has the low logic level, the eighth transistor may be turned on, and a voltage of the third transistor node may be equal to a voltage of the fourth transistor node.

In embodiments, when the pixel is driven at the second frequency, the emission bias signal may have a high logic level.

In embodiments, the pixel may further include a fifth transistor including a gate electrode to which an emission signal is applied, a first electrode to which the first power supply voltage is applied, and a second electrode connected to the second node, a sixth transistor including a gate electrode to which the emission signal is applied, a first electrode connected to the third node, and a second electrode connected to the anode electrode of the organic light emitting diode, and a seventh transistor including a gate electrode to which an anode initialization gate signal is applied, a first electrode connected to the initialization voltage input terminal, and a second electrode connected to the anode electrode of the organic light emitting diode.

In embodiments, the eighth transistor may control the current flowing through the third transistor and the current flowing through the fourth transistor in response to the emission bias signal when a gray level according to the data voltage is a first gray level. In addition, the eighth transistor may be turned off when the gray level according to the data voltage is a second gray level lower than the first gray level.

In embodiments, the first gray level may be greater than or equal to 127 G, and the second gray level may be greater than or equal to 0 G and less than 127 G.

In embodiments, when the gray level according to the data voltage is the first gray level, the emission bias signal may have a low logic level during an emission period of the pixel and may have a high logic level during a non-emission period of the pixel.

In embodiments, when the emission bias signal has the low logic level, the eighth transistor may be turned on, and a voltage of the third transistor node may be equal to a voltage of the fourth transistor node.

According to embodiments, an organic light emitting diode display device may include a display panel including a pixel, a data driver configured to provide a data voltage to the pixel, a gate driver configured to provide a gate signal to the pixel, and a driving controller configured to control the data driver and the gate driver. Here, the pixel may include a first capacitor including a first electrode to which a first power supply voltage is applied and a second electrode connected to a first node, a first transistor including a gate electrode connected to the first node, a first electrode connected to a second node, and a second electrode connected to a third node, a second transistor including a gate electrode to which a data write gate signal is applied, a first electrode to which a data voltage is applied, and a second electrode connected to the second node, a third transistor connected between the first node and the third node, and configured to diode-connect the first transistor in response to the data write gate signal, a fourth transistor connected between the first node and an initialization voltage input terminal to which an initialization voltage is applied, and configured to transmit the initialization voltage to the first node in response to a data initialization gate signal, an eighth transistor connected to the third transistor and the fourth transistor, and configured to control a current flowing through the third transistor and a current flowing through the fourth transistor in response to an emission bias signal, and an organic light emitting diode including an anode electrode and a cathode electrode to which a second power supply voltage is applied.

In embodiments, the third transistor may include a first sub-transistor and a second sub-transistor which are connected in series between the first node and the third node. In addition, the fourth transistor may include a third sub-transistor and a fourth sub-transistor which are connected in series between the first node and the initialization voltage input terminal. Further, the eighth transistor may include a gate electrode to which the emission bias signal is applied, a first electrode connected to a third transistor node disposed between the first sub-transistor and the second sub-transistor, and a second electrode connected to a fourth transistor node disposed between the third sub-transistor and the fourth sub-transistor.

In embodiments, the eighth transistor may control the current flowing through the third transistor and the current flowing through the fourth transistor in response to the emission bias signal when the pixel is driven at a first frequency. In addition, the eighth transistor may be turned off when the pixel is driven at a second frequency higher than the first frequency.

In embodiments, the first frequency may be greater than 0 Hz and less than 60 Hz, and the second frequency may be greater than or equal to 60 Hz.

In embodiments, when the pixel is driven at the first frequency, the emission bias signal may have a low logic level during an emission period of the pixel and may have a high logic level during a non-emission period of the pixel.

In embodiments, when the emission bias signal has the low logic level, the eighth transistor may be turned on, and a voltage of the third transistor node may be equal to a voltage of the fourth transistor node.

In embodiments, when the pixel is driven at the second frequency, the emission bias signal may have a high logic level.

In embodiments, the pixel may further include a fifth transistor including a gate electrode to which an emission signal is applied, a first electrode to which the first power supply voltage is applied, and a second electrode connected to the second node, a sixth transistor including a gate electrode to which the emission signal is applied, a first electrode connected to the third node, and a second electrode connected to the anode electrode of the organic light emitting diode, and a seventh transistor including a gate electrode to which an anode initialization gate signal is applied, a first electrode connected to the initialization voltage input terminal, and a second electrode connected to the anode electrode of the organic light emitting diode.

Therefore, a pixel and an organic light emitting diode display device including the pixel according to embodiments may include an eighth transistor that controls a current flowing through a third transistor and a current flowing through a fourth transistor in response to an emission bias signal. Due to a current control of the eighth transistor, a current imbalance between a leakage current of the third transistor and a leakage current of the fourth transistor can be reduced, and a driving current of an organic light emitting diode can be increased. Thus, image quality of the organic light emitting diode display device can be improved.

DETAILED DESCRIPTION OF THE EMBODIMENTS

Hereinafter, embodiments of the present disclosure will be explained in detail with reference to the accompanying drawings.

Figure 1:
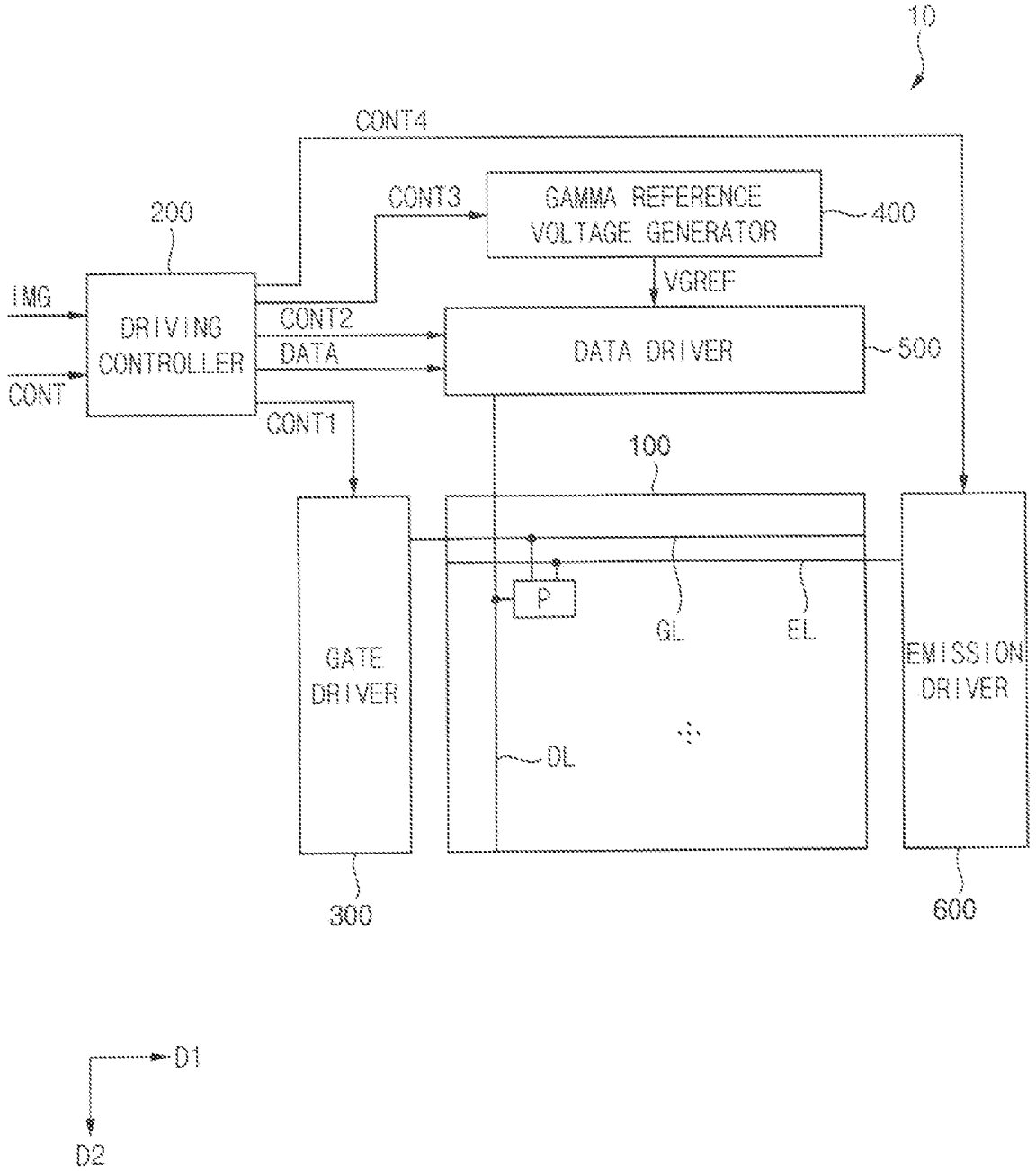
FIG. 1 is a block diagram illustrating an organic light emitting diode display device according to embodiments.
Figure 2:
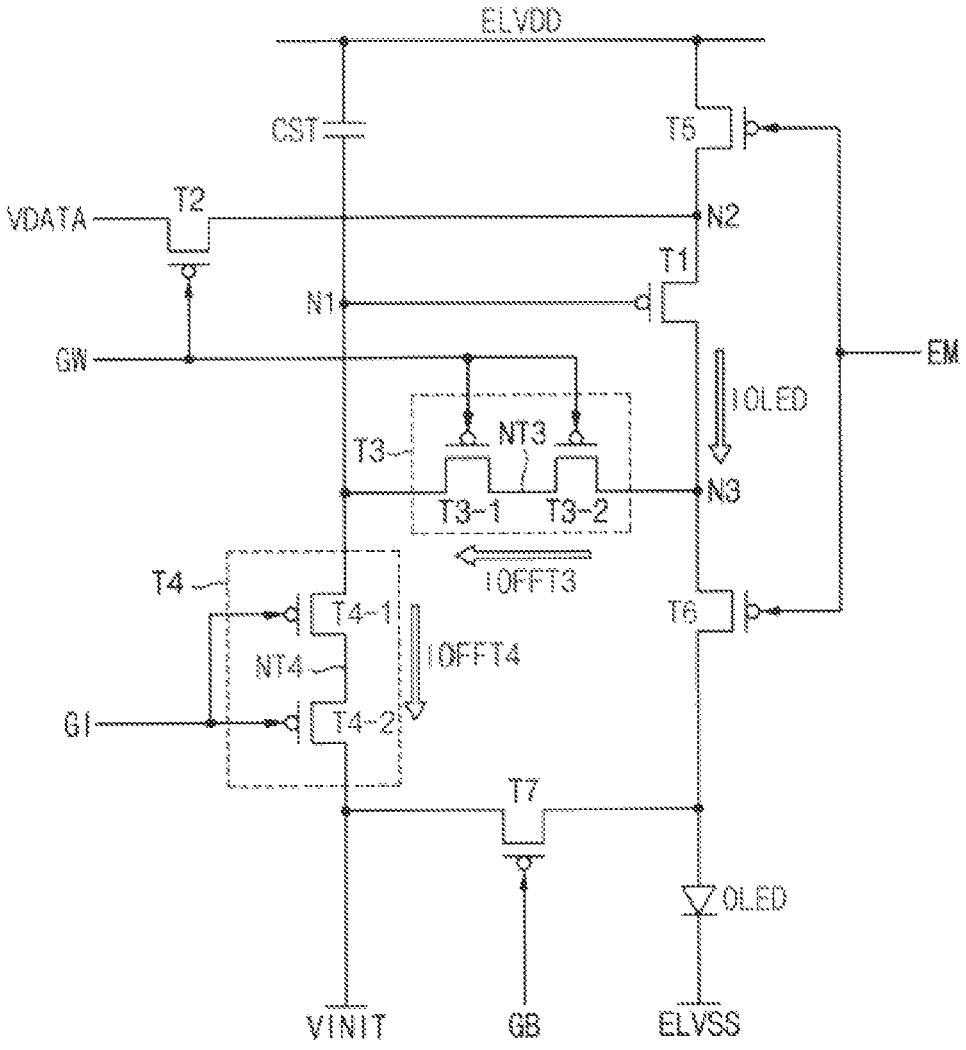
FIG. 2 is a circuit diagram illustrating an example of a pixel included in the organic light emitting diode display device of FIG. 1.

FIG. 1 is a block diagram illustrating an organic light emitting diode display device according to embodiments, and FIG. 2 is a circuit diagram illustrating an example of a pixel included in the organic light emitting diode display device of FIG. 1.

Referring to FIGS. 1 and 2, an organic light emitting diode display device 10 may include a display panel 100 and a display panel driver. The display panel driver may include a driving controller 200, a gate driver 300, a gamma reference voltage generator 400, a data driver 500, and an emission driver 600.

The display panel 100 may include a display area in which an image is displayed, and a peripheral area that is adjacent to the display area.

The display panel 100 may include a plurality of gate lines GL, a plurality of data lines DL, a plurality of emission lines EL, and a plurality of pixels P electrically connected to the gate lines GL, the data lines DL, and the emission lines EL, respectively. The gate lines GL may extend in a first direction D1, the data lines DL may extend in a second direction D2 intersecting the first direction D1, and the emission lines EL may extend in the first direction D1. For example, the gate lines GL may include a data write gate line to which a data write gate signal GW is applied, a data initialization gate line to which a data initialization gate signal GI is applied, an emission bias line to which an emission bias signal EB is applied, and an anode initialization gate line to which an anode initialization gate signal GB is applied.

The driving controller 200 may receive input image data IMG and an input control signal CONT from an external device (not shown). For example, the input image data IMG may include red image data, green image data, and blue image data. The input image data IMG may include white image data. For example, the input image data IMG may include magenta image data, yellow image data, and cyan image data. The input control signal CONT may include a master clock signal and a data enable signal. The input control signal CONT may further include a vertical synchronization signal and a horizontal synchronization signal.

The driving controller 200 may generate a first control signal CONT1, a second control signal CONT2, a third control signal CONT3, a fourth control signal CONT4, and a data signal DATA based on the input image data IMG and the input control signal CONT.

The driving controller 200 may generate the first control signal CONT1 for controlling an operation of the gate driver 300 based on the input control signal CONT to output the generated first control signal CONT1 to the gate driver 300. The first control signal CONT1 may include a vertical start signal and a gate clock signal.

The driving controller 200 may generate the second control signal CONT2 for controlling an operation of the data driver 500 based on the input control signal CONT to output the generated second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 for controlling an operation of the gamma reference voltage generator 400 based on the input control signal CONT to output the generated third control signal CONT3 to the gamma reference voltage generator 400.

The driving controller 200 may generate the fourth control signal CONT4 for controlling an operation of the emission driver 600 based on the input control signal CONT to output the generated fourth control signal CONT4 to the emission driver 600.

The gate driver 300 may generate gate signals for driving the gate lines GL in response to the first control signal CONT1 received from the driving controller 200. The gate driver 300 may output the gate signals to the gate lines GL. For example, the gate driver 300 may output the data write gate signal GW to the data write gate line. The gate driver 300 may output the data initialization gate signal GI to the data initialization gate line. The gate driver 300 may output the emission bias signal EB to the emission bias line. The gate driver 300 may output the anode initialization gate signal GB to the anode initialization gate line.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to each data signal DATA.

For example, the gamma reference voltage generator 400 may be embedded in the driving controller 200 or the data driver 500.

The data driver 500 may receive the second control signal CONT2 and the data signal DATA from the driving controller 200, and receive the gamma reference voltage VGREF from the gamma reference voltage generator 400. The data driver 500 may convert the data signal DATA into an analog data voltage VDATA by using the gamma reference voltage VGREF. The data driver 500 may output the data voltage VDATA to the data line DL.

The emission driver 600 may generate emission signals for driving the emission lines EL in response to the fourth control signal CONT4 received from the driving controller 200. The emission driver 600 may output the emission signals to the emission lines EL.

According to embodiments, the display panel 100 may include a plurality of pixels P, and each of the pixels P may include an organic light emitting diode OLED. According to one embodiment of the present disclosure, the pixel P may include a first capacitor CST, a first transistor T1, a second transistor T2, a third transistor T3, a fourth transistor T4, and an organic light emitting diode OLED. According to one embodiment, the pixel P may further include a fifth transistor T5, a sixth transistor T6, and a seventh transistor T7.

The first capacitor CST may store a voltage difference between a first power supply voltage ELVDD and the voltage of the first node which is connected to the gate of the first transistor T1. For example, the first node voltage may be the sum of the data voltage VDATA and a threshold voltage (Vth) of the first transistor T1. According to one embodiment, the first capacitor CST may include a first electrode to which the first power supply voltage ELVDD is applied and a second electrode connected to the first node N1.

The first transistor T1 may generate a driving current IDLED based on the voltage stored in the first capacitor CST, that is, a voltage of the first node N1. The first transistor T1 may be referred to as a driving transistor. According to one embodiment, the first transistor T1 may include a gate electrode connected to the second electrode of the first capacitor CST, that is, the first node N1, a first electrode connected to a second node N2, and a second electrode connected to a third node N3.

The second transistor T2 may transmit the data voltage VDATA to the first electrode of the first transistor T1 in response to the data write gate signal GW. The second transistor T2 may be referred to as a switching transistor or a scan transistor. According to one embodiment, the second transistor T2 may include a gate electrode to which the data write gate signal GW is applied, a first electrode to which the data voltage VDATA is applied, and a second electrode connected to the second node N2.

The third transistor T3 may diode-connect the first transistor T1 in response to the data write gate signal GW. The third transistor T3 may be referred to as a threshold voltage compensation transistor. According to one embodiment, the third transistor T3 may include a gate electrode to which the data write gate signal GW is applied, a first electrode connected to the first node N1, and a second electrode connected to the third node N3. While the data write gate signal GW is applied, the voltage difference between a first power supply voltage ELVDD and the voltage of the first node which is connected to the gate of the first transistor T1 may be stored in the first capacitor CST. For example, the third transistor T3 may include a first sub-transistor T3-1 and a second sub-transistor T3-2 which are connected in series between the first node N1 and the third node N3.

The fourth transistor T4 may transmit an initialization voltage VINIT to the first node N1 in response to the data initialization gate signal GI. The fourth transistor T4 may be referred to as a gate initialization transistor. According to one embodiment, the fourth transistor T4 may include a gate electrode to which the data initialization gate signal GI is applied, a first electrode connected to the first node N1, and a second electrode connected to an initialization voltage input terminal to which the initialization voltage VINIT is applied. While the data initialization gate signal GI is applied, the fourth transistor T4 may initialize the first node N1, that is, the first capacitor CST and the gate electrode of the first transistor T1 by using the initialization voltage VINIT. For example, the fourth transistor T4 may include a third sub-transistor T4-1 and a fourth sub-transistor T4-2 which are connected in series between the first node N1 and the initialization voltage input terminal to which the initialization voltage is applied.

The fifth transistor T5 may connect the first power supply voltage ELVDD line to the first electrode of the first transistor T1 in response to an emission signal EM. The fifth transistor T5 may be referred to as a first light emitting transistor. According to one embodiment, the fifth transistor T5 may include a gate electrode to which the emission signal EM is applied, a first electrode to which the first power supply voltage ELVDD is applied, and a second electrode connected to the second node N2.

The sixth transistor T6 may connect the second electrode of the first transistor T1 to an anode electrode of the organic light emitting diode OLED in response to the emission signal EM. The sixth transistor T6 may be referred to as a second light emitting transistor. According to one embodiment, the sixth transistor T6 may include a gate electrode to which the emission signal EM is applied, a first electrode connected to the second electrode of the first transistor T1, and a second electrode connected to the anode electrode of the organic light emitting diode OLED. While the emission signal EM is applied, the fifth and sixth transistors T5 and T6 may be simultaneously turned on, and a path of the driving current IDLED from the first power supply voltage ELVDD line to a second power supply voltage ELVSS line may be formed.

The seventh transistor T7 may transmit the initialization voltage VINIT to the anode electrode of the organic light emitting diode OLED in response to the anode initialization gate signal GB. The seventh transistor T7 may be referred to as an anode initialization transistor or a diode initialization transistor. According to one embodiment, the seventh transistor T7 may include a gate electrode to which the anode initialization gate signal GB is applied, a first electrode connected to the initialization voltage input terminal, and a second electrode connected to the anode electrode of the organic light emitting diode OLED. While the anode initialization gate signal GB is applied, the seventh transistor T7 may initialize the organic light emitting diode OLED by using the initialization voltage VINIT.

The organic light emitting diode OLED may emit light based on the driving current IDLED generated by the first transistor T1. According to one embodiment, an organic light emitting diode OLED may have an anode electrode connected to the second electrode of the sixth transistor T6, and a cathode electrode to which the second power supply voltage ELVSS is applied. While the emission signal EM is applied, the driving current IDLED generated by the first transistor T1 may be provided to the organic light emitting diode OLED, and the organic light emitting diode OLED may emit the light based on the driving current IDLED.

The organic light emitting diode display device including the pixel P may perform low-frequency driving to reduce power consumption. During the low-frequency driving, each of the pixels P may emit light based on the voltage stored in the first capacitor CST in a previous frame period without receiving the data initialization gate signal GI, the data write gate signal GW, and the data voltage VDATA in at least some of a plurality of frame periods. In this case, due to leakage currents of the transistors T1 to T7 of the pixel P, in particular, due to leakage currents flowing through the third transistor T3 and the fourth transistor T4, the voltage of the first node N1 may be distorted, and image quality of the organic light emitting diode display device may deteriorate. For example, the voltage of the first node N1 may be distorted by a third transistor leakage current IOFFT3 and a fourth transistor leakage current IOFFT4.

According to one embodiment, each of the third and fourth transistors T3 and T4 may have a dual transistor structure to reduce the third transistor leakage current IOFFT3 and the fourth transistor leakage current IOFFT4. For example, as shown in FIG. 2, the third transistor T3 may include a first sub-transistor T3-1 and a second sub-transistor T3-2 which are connected in series between the first node N1 and the third node N3. The fourth transistor T4 may include a third sub-transistor T4-1 and a fourth sub-transistor T4-2 which are connected in series between the first node N1 and the initialization voltage input terminal to which the initialization voltage VINIT is applied. When the third transistor T3 includes the first sub-transistor T3-1 and the second sub-transistor T3-2, the third transistor leakage current IOFFT3 from the second electrode of the first transistor T1 to the first node N1 may be reduced. In addition, when the fourth transistor T4 includes the third sub-transistor T4-1 and the fourth sub-transistor T4-2, the fourth transistor leakage current IOFFT4 from the initialization voltage input terminal to the first node N1 may be reduced.

However, even when the third transistor T3 includes the first sub-transistor T3-1 and the second sub-transistor T3-2, a parasitic capacitor may be formed between a third transistor node NT3 which is disposed between the first sub-transistor T3-1 and the second sub-transistor T3-2, and a wire of the pixel P (e.g., the data write gate line to which the data write gate signal GW is applied), and a leakage current of the first sub-transistor T3-1 from the third transistor node NT3 to the first node N1 may be generated. In addition, even when the fourth transistor T4 includes the third sub-transistor T4-1 and the fourth sub-transistor T4-2, a parasitic capacitor may be formed between a fourth transistor node NT4 which is disposed between the third sub-transistor T4-1 and the fourth sub-transistor T4-2, and a wire of the pixel P (e.g., the data initialization gate line to which the data initialization gate signal GI is applied), and a leakage current of the third sub-transistor T4-1 from the fourth transistor node NT4 to the first node N1 may be generated. In addition, due to the parasitic capacitor between the third transistor node NT3 and the wire of the pixel P and the parasitic capacitor between the fourth transistor node NT4 and the wire of the pixel P, a current imbalance may occur between the third transistor leakage current IOFFT3 and the fourth transistor leakage current IOFFT4. Due to the current imbalance between the third transistor leakage current IOFFT3 and the fourth transistor leakage current IOFFT4, the voltage of the first node N1 may be increased, the driving current IOLED of the driving transistor T1 may be decreased, and a luminance of the organic light emitting diode OLED may be decreased.

The pixel P of the organic light emitting diode display device according to one embodiment of the present disclosure may include an eighth transistor T8 configured to control the current flowing through the third transistor T3 and the current flowing through the fourth transistor T4 in response to the emission bias signal EB to compensate for the distortion of the voltage of the first node N1 caused by the leakage current of the first sub-transistor T3-1 and the leakage current of the third sub-transistor T4-1.

Figure 3:
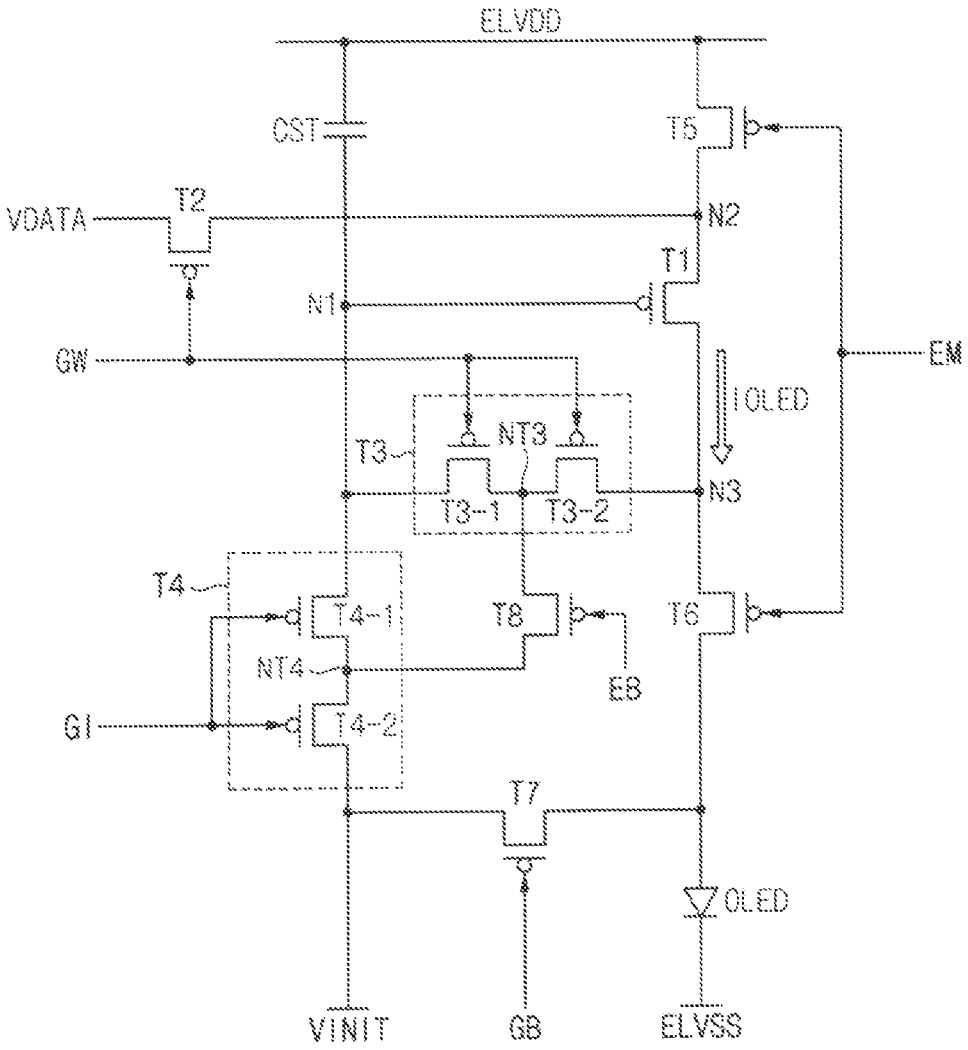
FIG. 3 is a circuit diagram illustrating a pixel according to embodiments.

FIG. 3 is a circuit diagram illustrating a pixel according to embodiments.

Referring to FIGS. 1 and 3, the display panel 100 may include a plurality of pixels P, and each of the pixels P may include an organic light emitting diode OLED. According to one embodiment of the present disclosure, the pixel P may include a first capacitor CST, a first transistor T1, a second transistor T2, a third transistor T3, a fourth transistor T4, a fifth transistor T5, a sixth transistor T6, a seventh transistor T7, an eighth transistor T8, and an organic light emitting diode OLED.

The first transistor T1 may include a gate electrode connected to the second electrode of the first capacitor CST, that is, the first node N1, a first electrode connected to the second node N2, and a second electrode connected to the third node N3.

The second transistor T2 may include a gate electrode to which the data write gate signal GW is applied, a first electrode to which the data voltage VDATA is applied, and a second electrode connected to the second node N2.

The third transistor T3 may include a gate electrode to which the data write gate signal GW is applied, a first electrode connected to the first node N1, and a second electrode connected to the third node N3. The third transistor T3 may include a first sub-transistor T3-1 and a second sub-transistor T3-2 which are connected in series between the first node N1 and the third node N3.

The fourth transistor T4 may include a gate electrode to which the data initialization gate signal GI is applied, a first electrode connected to the first node N1, and a second electrode connected to the initialization voltage input terminal to which the initialization voltage VINIT is applied. The fourth transistor T4 may include a third sub-transistor T4-1 and a fourth sub-transistor T4-2 which are connected in series between the first node N1 and the initialization voltage input terminal to which the initialization voltage is applied The fifth transistor T5 may include a gate electrode to which the emission signal EM is applied, a first electrode to which the first power supply voltage ELVDD is applied, and a second electrode connected to the second node N2.

The sixth transistor T6 may include a gate electrode to which the emission signal EM is applied, a first electrode connected to the second electrode of the first transistor T1, and a second electrode connected to the anode electrode of the organic light emitting diode OLED.

The seventh transistor T7 may include a gate electrode to which the anode initialization gate signal GB is applied, a first electrode connected to the initialization voltage input terminal, and a second electrode connected to the anode electrode of the organic light emitting diode OLED.

The eighth transistor T8 may control the current flowing through the third transistor T3 and the current flowing through the fourth transistor T4 in response to the emission bias signal EB. The eighth transistor T8 may be referred to as a synchronization transistor and a stabilization transistor. The eighth transistor T8 may include a gate electrode to which the emission bias signal EB is applied, a first electrode connected to the third transistor node NT3 disposed between the first sub-transistor T3-1 and the second sub-transistor T3-2, and a second electrode connected to the fourth transistor node NT4 disposed between the third sub-transistor T4-1 and the fourth sub-transistor T4-2.

According to one embodiment, the eighth transistor T8 may be controlled according to a driving frequency of the display panel 100. In other words, the eighth transistor T8 may be controlled according to a driving frequency of the pixel P. The eighth transistor T8 may operate when the driving frequency of the pixel P is a low frequency, and may not operate when the driving frequency of the pixel P is a high frequency. For example, when the driving frequency of the pixel P is a low frequency, the eighth transistor T8 may control the current flowing through the third transistor T3 and the current flowing through the fourth transistor T4 in response to the emission bias signal EB. When the driving frequency of the pixel P is a high frequency, the eighth transistor T8 may not control the current flowing through the third transistor T3 and the current flowing through the fourth transistor T4.

According to one embodiment, the eighth transistor T8 may be controlled according to a gray level of the data voltage VDATA. The eighth transistor T8 may operate when the gray level of the data voltage VDATA applied to the pixel P is a high gray level, and may not operate when the gray level of the data voltage VDATA applied to the pixel P is a low gray level. For example, when the gray level of the data voltage VDATA is a high gray level, the eighth transistor T8 may control the current flowing through the third transistor T3 and the current flowing through the fourth transistor T4 in response to the emission bias signal EB. When the gray level according to the data voltage VDATA is a low gray level, the eighth transistor T8 may not control the current flowing through the third transistor T3 and the current flowing through the fourth transistor T4.

Due to the above current control of the eighth transistor, a current imbalance between a leakage current of the third transistor T3 and a leakage current of the fourth transistor T4 may be reduced, and the driving current IDLED applied to the organic light emitting diode may be increased. Therefore, the image quality of the organic light emitting diode display device may be improved.

Figure 4:
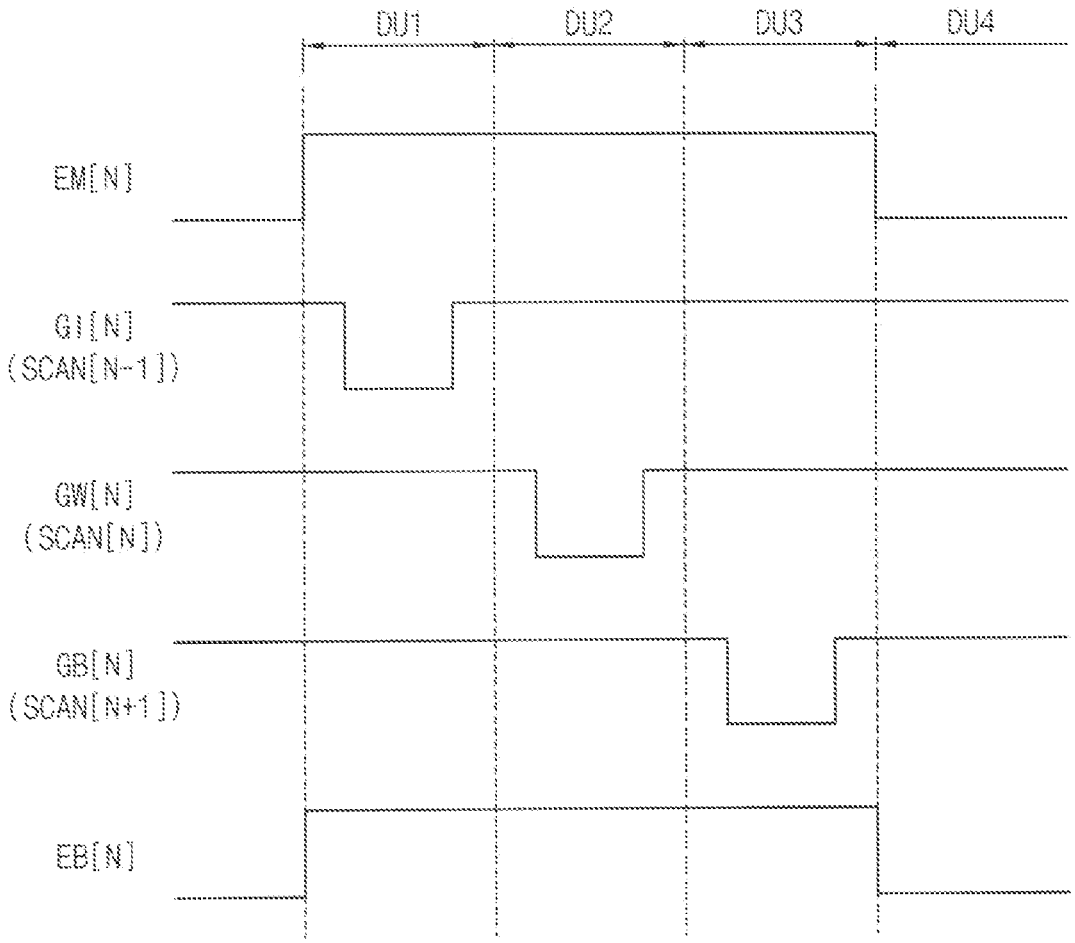
FIG. 4 is a timing diagram illustrating an example of a gate signal and an emission signal applied to the pixel of FIG. 3.
Figure 5:
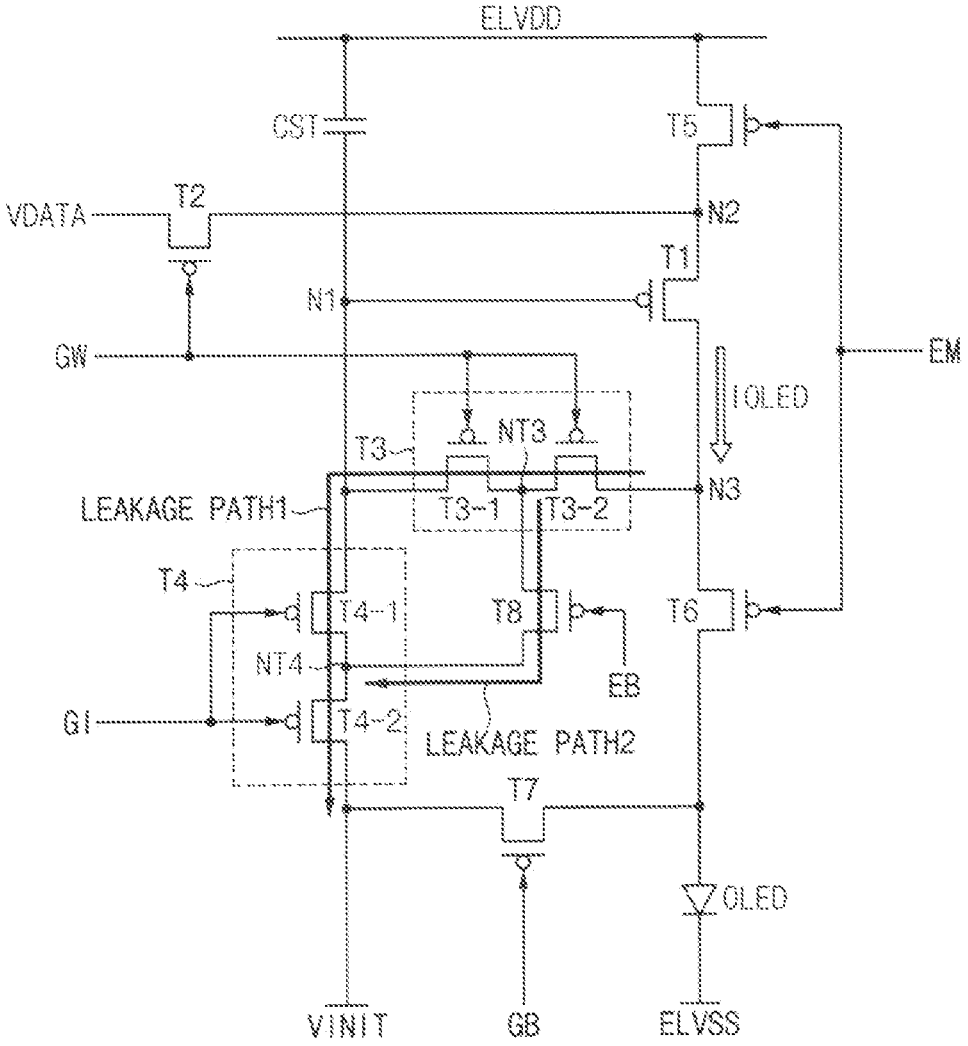
FIG. 5 is a circuit diagram illustrating an operation of the pixel of FIG. 3 when the gate signal and the emission signal according to FIG. 4 are applied to the pixel of FIG. 3.
Figure 6:
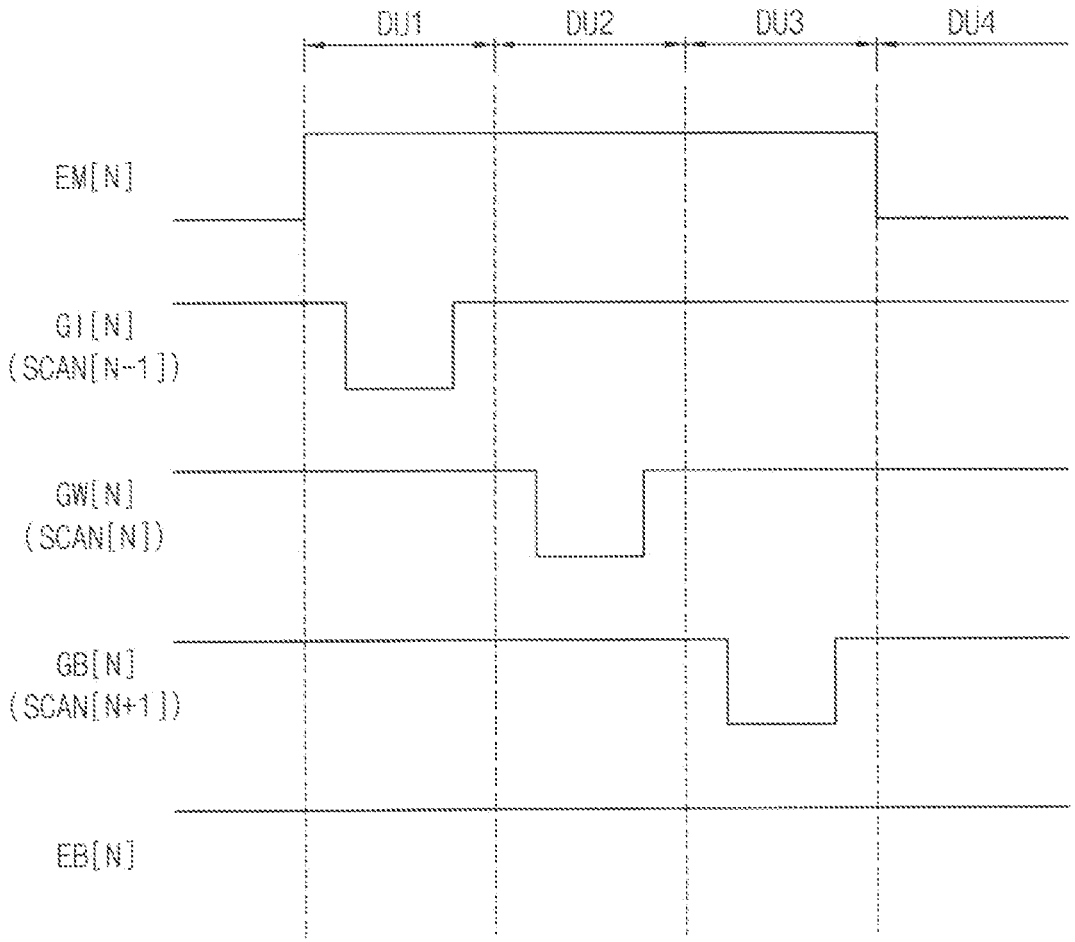
FIG. 6 is a timing diagram illustrating another example of a gate signal and an emission signal applied to the pixel of FIG. 3.
Figure 7:
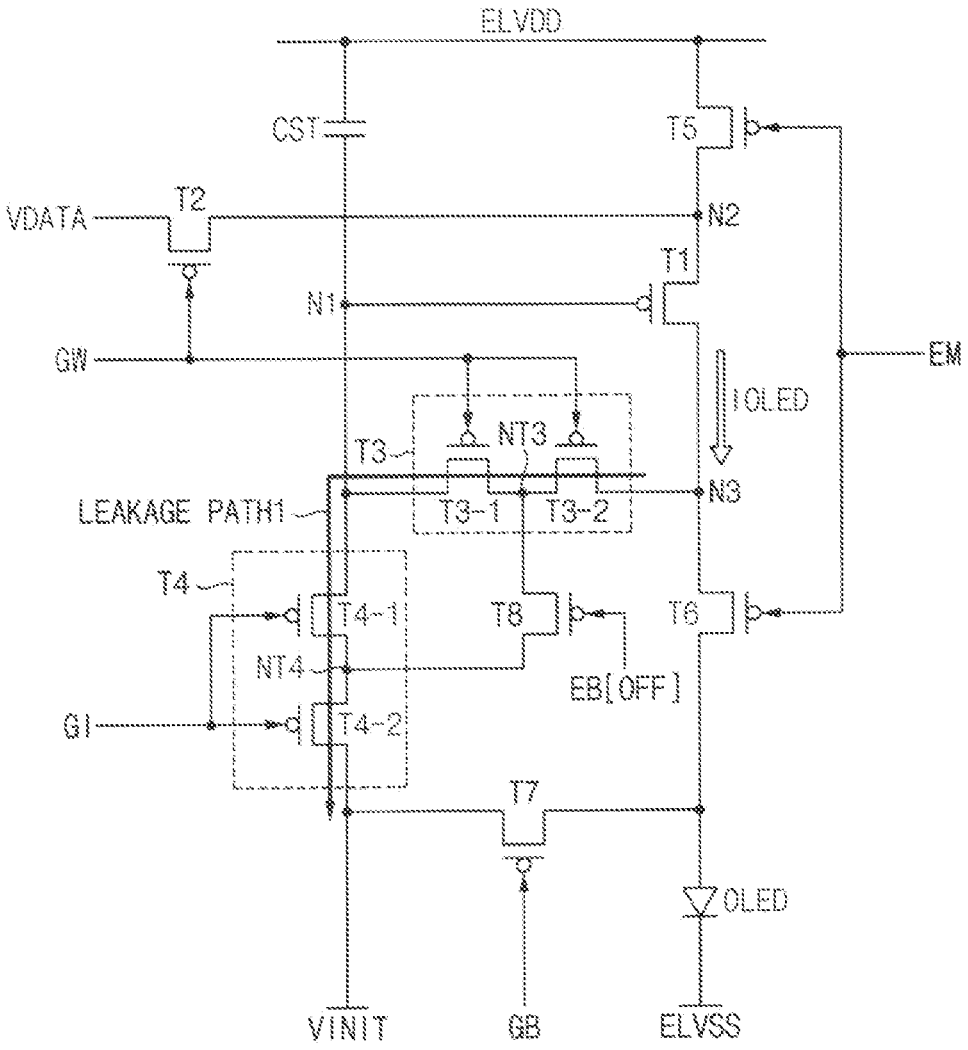
FIG. 7 is a circuit diagram illustrating an operation of the pixel of FIG. 3 when the gate signal and the emission signal according to FIG. 6 are applied to the pixel of FIG. 3.

FIG. 4 is a timing diagram illustrating an example of a gate signal and an emission signal applied to the pixel of FIG. 3, FIG. 5 is a circuit diagram illustrating an operation of the pixel of FIG. 3 when the gate signal and the emission signal according to FIG. 4 are applied to the pixel of FIG. 3, FIG. 6 is a timing diagram illustrating another example of a gate signal and an emission signal applied to the pixel of FIG. 3, and FIG. 7 is a circuit diagram illustrating an operation of the pixel of FIG. 3 when the gate signal and the emission signal according to FIG. 6 are applied to the pixel of FIG. 3.

The operation period of the pixel P may include a first period DU1 in which the gate electrode of the first transistor T1 is initialized, a second period DU2 in which the data voltage VDATA for which the threshold voltage is compensated is written, a third period DU3 in which the anode electrode of the organic light emitting diode OLED is initialized, and a fourth period DU4 in which the organic light emitting diode OLED emits light. The pixels P may receive the data write gate signal GW, the data initialization gate signal GI, the anode initialization gate signal GB, the emission bias signal EB, the data voltage VDATA, and the emission signal EM, and may allow the organic light emitting diode OLED to emit the light according to a level of the voltage stored in the first capacitor CST so as to display an image.

According to one embodiment, the eighth transistor T8 may be controlled according to the driving frequency of the display panel 100. In other words, the eighth transistor T8 may be controlled according to the driving frequency of the pixel P. The eighth transistor T8 may operate when the driving frequency of the pixel P is a low frequency, and may not operate when the driving frequency of the pixel P is a high frequency.

In detail, when the driving frequency of the pixel P is a low frequency, the eighth transistor T8 may control the current flowing through the third transistor T3 and the current flowing through the fourth transistor T4 in response to the emission bias signal EB. When the driving frequency of the pixel P is a high frequency, the eighth transistor T8 may be turned off, and may not control the current flowing through the third transistor T3 and the current flowing through the fourth transistor T4. For example, the low frequency may be a frequency that is greater than 0 Hz and less than 60 Hz. For example, the high frequency may be greater than or equal to 60 Hz. However, the above frequency range has been provided for illustrative purposes, and the high and low frequencies according to the present disclosure are not limited to the above frequency range.

During the fourth period DU4, the leakage currents flowing through the third transistor T3 and the fourth transistor T4 may flow along a first current path LEACKAGE PATH1. During the fourth period DU4, due to the parasitic capacitor between the third transistor node NT3 and the wire of the pixel P and the parasitic capacitor between the fourth transistor node NT4 and the wire of the pixel P, a current imbalance may occur between the leakage current of the third transistor T3 flowing along the first current path LEACKAGE PATH1 and the leakage current of the fourth transistor T4 flowing along the first current path LEACKAGE PATH1. In this case, due to the current imbalance, the voltage of the first node N1 may be increased, the driving current IDLED of the driving transistor T1 may be decreased, and the luminance of the organic light emitting diode OLED may be decreased.

Referring to FIGS. 4 and 5, when the driving frequency of the pixel P is a low frequency, the eighth transistor T8 may control the current flowing through the third transistor T3 and the current flowing through the fourth transistor T4 in response to the emission bias signal EB. When the driving frequency of the pixel P is a low frequency, the eighth transistor T8 may be turned on in response to the emission bias signal EB so as to form a second current path LEACKAGE PATH2. When the second current path LEACKAGE PATH2 is formed, the leakage current of the third transistor T3 and the leakage current of the fourth transistor T4 may flow along the second current path LEACKAGE PATH2 as well as the first current path LEACKAGE PATH1. When the leakage current of the third transistor T3 and the leakage current of the fourth transistor T4 flow along the second current path LEACKAGE PATH2 as well as the first current path LEACKAGE PATH1, the current imbalance between the leakage current of the third transistor T3 and the leakage current of the fourth transistor T4 may be reduced.

According to one embodiment, when the pixel is driven at a frequency that is greater than 0 Hz and less than 60 Hz, the emission bias signal EB may have a low logic level during the fourth period DU4 in which the organic light emitting diode OLED emits the light. When the pixel is driven at a low frequency, the emission bias signal EB may have a high logic level during the first period DU1, the second period DU2, and the third period DU3 in which the organic light emitting diode OLED does not emit the light.

In detail, when the emission bias signal EB has a low logic level, the eighth transistor may be turned on. When the eighth transistor is turned on, a voltage of the third transistor node NT3 may become equal to a voltage of the fourth transistor node NT4. In other words, when the eighth transistor is turned on, the third transistor node NT3 and the fourth transistor node NT4 may be synchronized with each other. In this case, the leakage current of the third transistor T3 and the leakage current of the fourth transistor T4 may flow along the second current path LEACKAGE PATH2 as well as the first current path LEACKAGE PATH1.

For example, during the first period DU1, the fourth transistor T4 may be turned on, and the initialization voltage VINIT may be applied to the first node N1 to initialize the gate electrode of the first transistor T1. During the second period DU2, the second transistor T2 and the third transistor T3 may be turned on. As the second transistor T2 is turned on, the data voltage VDATA may be supplied to the first node N1, and as the third transistor T3 is turned on, the first transistor T1 may be diode-connected. Therefore, the data voltage VDATA for which the threshold voltage of the first transistor T1 is compensated may be applied to the first node and the voltage difference between the first power supply voltage ELVDD and the voltage of the first node is stored in the first capacitor CST. During the third period DU3, the seventh transistor T7 may be turned on, and the initialization voltage VINIT may be applied to the anode electrode of the organic light emitting diode OLED so that the anode electrode of the organic light emitting diode OLED may be initialized. During the fourth period DU4, the fifth transistor T5 and the sixth transistor T6 may be turned on so that the driving current generated by the first transistor T1 may flow to the organic light emitting diode OLED. During the fourth period DU4, the eighth transistor may also be turned on so that the second current path LEACKAGE PATH2 may be formed. When the second current path LEACKAGE PATH2 is formed, the leakage current of the third transistor T3 and the leakage current of the fourth transistor T4 may flow along the second current path LEACKAGE PATH2 as well as the first current path LEACKAGE PATH1.

Referring to FIGS. 6 and 7, when the driving frequency of the pixel P is a high frequency, the eighth transistor T8 may be turned off, and may not control the current flowing through the third transistor T3 and the current flowing through the fourth transistor T4. For example, when the pixel is driven at a frequency that is greater than or equal to 60 Hz, the emission bias signal EB may have a high logic level during the first to fourth periods DU1 to DU4.

When the emission bias signal EB has a high logic level during the first to fourth periods DU1 to DU4, the leakage current of the third transistor T3 and the leakage current of the fourth transistor T4 may flow only along the first current path LEACKAGE PATH1. In other words, when the emission bias signal EB has a high logic level, the leakage current of the third transistor T3 and the leakage current of the fourth transistor T4 may not flow along the second current path LEACKAGE PATH2. According to the organic light emitting diode display device of the present disclosure, when the driving frequency of the pixel P is a high frequency, the eighth transistor T8 may be turned off, so that the eighth transistor T8 may be efficiently operated, and additional power consumption caused by the operation of the eighth transistor T8 may be minimized.

Due to the above current control of the eighth transistor, when the pixel is driven at a low frequency, the current imbalance between the leakage current of the third transistor T3 and the leakage current of the fourth transistor T4 may be reduced, and the driving current IDLED applied to the organic light emitting diode may be increased. Therefore, the image quality of the organic light emitting diode display device may be improved.

According to one embodiment, the eighth transistor T8 may be controlled according to the gray level according to the data voltage VDATA. The eighth transistor T8 may operate when the gray level according to the data voltage VDATA applied to the pixel P is a high gray level, and may not operate when the gray level according to the data voltage VDATA applied to the pixel P is a low gray level.

In detail, when the gray level according to the data voltage VDATA is a high gray level, the eighth transistor T8 may control the current flowing through the third transistor T3 and the current flowing through the fourth transistor T4 in response to the emission bias signal EB. When the gray level according to the data voltage VDATA is a low gray level, the eighth transistor T8 may be turned off, and may not control the current flowing through the third transistor T3 and the current flowing through the fourth transistor T4. For example, the high gray level may be greater than or equal to 127 G. For example, the low gray level may be greater than or equal to 0 G and less than 127 G. However, the above gray level range has been provided for illustrative purposes, and the high and low gray levels according to the present disclosure are not limited to the above gray level range.

For example, when the gray level according to the data voltage VDATA applied to the pixel P is a high gray level, the emission bias signal EB may have a low logic level during the fourth period DU4 in which the organic light emitting diode OLED emits the light. When the gray level according to the data voltage VDATA applied to the pixel P is a high gray level, the emission bias signal EB may have a high logic level during the first period DU1, the second period DU2, and the third period DU3 in which the organic light emitting diode OLED does not emit the light.

When the gray level according to the data voltage VDATA applied to the pixel P is a high gray level, the eighth transistor T8 may control the current flowing through the third transistor T3 and the current flowing through the fourth transistor T4 in response to the emission bias signal EB. When the gray level according to the data voltage VDATA applied to the pixel P is a high gray level, the eighth transistor T8 may be turned on in response to the emission bias signal EB so as to form the second current path LEACKAGE PATH2. When the second current path LEACKAGE PATH2 is formed, the leakage current of the third transistor T3 and the leakage current of the fourth transistor T4 may flow along the second current path LEACKAGE PATH2 as well as the first current path LEACKAGE PATH1. When the leakage current of the third transistor T3 and the leakage current of the fourth transistor T4 flow along the second current path LEACKAGE PATH2 as well as the first current path LEACKAGE PATH1, the current imbalance between the leakage current of the third transistor T3 and the leakage current of the fourth transistor T4 may be reduced.

When the gray level according to the data voltage VDATA applied to the pixel P is a low gray level, the eighth transistor T8 may be turned off, and may not control the current flowing through the third transistor T3 and the current flowing through the fourth transistor T4. For example, when the gray level according to the data voltage VDATA applied to the pixel P is a low gray level, the emission bias signal EB may have a high logic level during the first to fourth periods DU1 to DU4. According to the organic light emitting diode display device of the present disclosure, when the gray level according to the data voltage VDATA applied to the pixel P is a low gray level, the eighth transistor T8 may be turned off, so that the eighth transistor T8 may be efficiently operated, and the additional power consumption caused by the operation of the eighth transistor T8 may be minimized.

Due to the above current control of the eighth transistor, when the gray level according to the data voltage VDATA is a high gray level, the current imbalance between the leakage current of the third transistor T3 and the leakage current of the fourth transistor T4 may be reduced, and the driving current IOLED applied to the organic light emitting diode may be increased. Therefore, the image quality of the organic light emitting diode display device may be improved.

Figure 8:
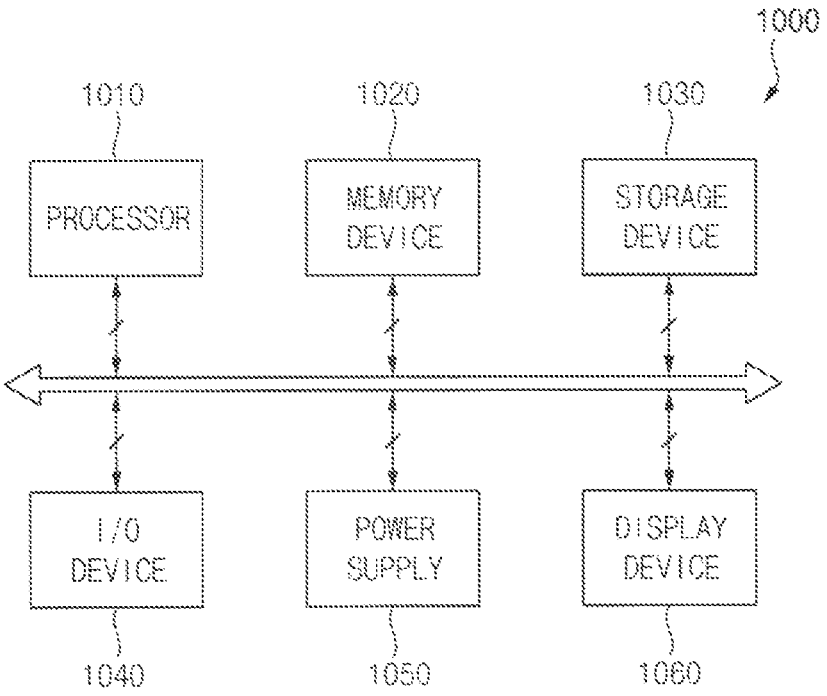
FIG. 8 is a block diagram illustrating an electronic device according to embodiments.
Figure 9:
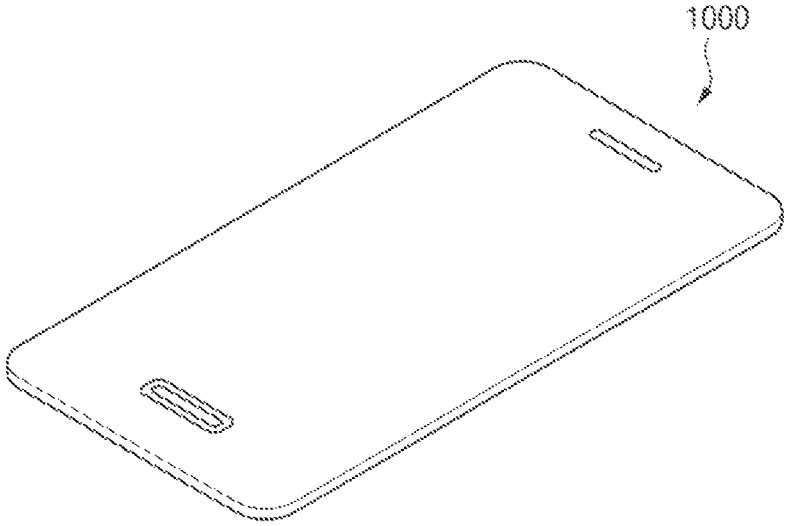
FIG. 9 is a diagram illustrating an example in which the electronic device of FIG. 8 is implemented as a smart phone.

FIG. 8 is a block diagram illustrating an electronic device according to embodiments, and FIG. 9 is a diagram illustrating an example in which the electronic device of FIG. 8 is implemented as a smart phone.

Referring to FIGS. 8 and 9, the electronic device 1000 may include a processor 1010, a memory device 1020, a storage device 1030, an input/output (I/O) device 1040, a power supply 1050, and a display device 1060. Here, the display device 1060 may be the organic light emitting diode display device 10 of FIG. 1. In addition, the electronic device 1000 may further include a plurality of ports for communicating with a video card, a sound card, a memory card, a universal serial bus (USB) device, other electronic devices, etc. In an embodiment, as illustrated in FIG. 9, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, etc.

The processor 1010 may perform various computing functions. The processor 1010 may be a micro processor, a central processing unit (CPU), an application processor (AP), etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc and/or at least one volatile memory device such as a dynamic random access memory (DRAM) device, a static random access memory (SRAM) device, a mobile DRAM device, etc. The storage device 1030 may include a solid state drive (SSD) device, a hard disk drive (HDD) device, a CD-ROM device, etc. The I/O device 1040 may include an input device such as a keyboard, a keypad, a mouse device, a touch pad, a touch screen, etc, and an output device such as a printer, a speaker, etc. In some embodiments, the I/O device 1040 may include the display device 1060. The power supply 1050 may provide power for operations of the electronic device 1000. The display device 1060 may be coupled to other components via the buses or other communication links.

The display device 1060 may display an image corresponding to visual information of the electronic device 1000. The display device 1060 may include a display panel including a pixel, a data driver configured to provide a data voltage to the pixel, a gate driver configured to provide a gate signal to the pixel, and a driving controller configured to control the data driver and the gate driver. The pixel may include a first capacitor including a first electrode to which a first power supply voltage is applied and a second electrode connected to a first node, a first transistor including a gate electrode connected to the first node, a first electrode connected to a second node, and a second electrode connected to a third node, a second transistor including a gate electrode to which a data write gate signal is applied, a first electrode to which a data voltage is applied, and a second electrode connected to the second node, a third transistor configured to diode-connect the first transistor in response to the data write gate signal, a fourth transistor configured to transmit an initialization voltage to the first node in response to a data initialization gate signal, an eighth transistor configured to control a current flowing through the third transistor and a current flowing through the fourth transistor in response to an emission bias signal, and an organic light emitting diode including an anode electrode and a cathode electrode to which a second power supply voltage is applied. The third transistor may include a first sub-transistor and a second sub-transistor which are connected in series between the first node and the third node. The fourth transistor may include a third sub-transistor and a fourth sub-transistor which are connected in series between the first node and an initialization voltage input terminal to which the initialization voltage is applied. Due to the above current control of the eighth transistor of the display device 1060 according to the present disclosure, a current imbalance between a leakage current of the third transistor and a leakage current of the fourth transistor within the pixel may be reduced, and a driving current applied to the light emitting diode may be increased. Therefore, image quality of the display device 1060 may be improved. Since these are described above, duplicated description related thereto will not be repeated.

The present disclosure may be applied to an organic light emitting diode display device and an electronic device including the organic light emitting diode display device. For example, the present disclosure may be applied to a cellular phone, a smart phone, a personal computer (PC), a tablet PC, a laptop, a television (TV), a digital TV, a home appliance, a personal digital assistants (PDA), a portable multimedia player (PMP), a digital camera, a music player, a portable game console, a car navigation system, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present disclosure. Accordingly, all such modifications are intended to be included within the scope of the present disclosure as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A pixel comprising:

a first capacitor including a first electrode to which a first power supply voltage is applied and a second electrode connected to a first node;

a first transistor including a gate electrode connected to the first node, a first electrode connected to a second node, and a second electrode connected to a third node;

a second transistor including a gate electrode to which a data write gate signal is applied, a first electrode to which a data voltage is applied, and a second electrode connected to the second node;

a third transistor connected between the first node and the third node, and configured to diode-connect the first transistor in response to the data write gate signal;

a fourth transistor connected between the first node and an initialization voltage input terminal to which an initialization voltage is applied, and configured to transmit the initialization voltage to the first node in response to a data initialization gate signal;

an eighth transistor connected to the third transistor and the fourth transistor, and configured to control a current flowing through the third transistor and a current flowing through the fourth transistor in response to an emission bias signal; and an organic light emitting diode including an anode electrode and a cathode electrode to which a second power supply voltage is applied, wherein the third transistor includes a first sub-transistor and a second sub-transistor which are connected in series between the first node and the third node, wherein the fourth transistor includes a third sub-transistor and a fourth sub-transistor which are connected in series between the first node and the initialization voltage input terminal, and wherein the eighth transistor includes a gate electrode to which the emission bias signal is applied, a first electrode connected to a third transistor node disposed between the first sub-transistor and the second sub-transistor, and a second electrode connected to a fourth transistor node disposed between the third sub-transistor and the fourth sub-transistor.

2. The pixel of claim 1, wherein the eighth transistor controls the current flowing through the third transistor and the current flowing through the fourth transistor in response to the emission bias signal when the pixel is driven at a first frequency, and wherein the eighth transistor is turned off when the pixel is driven at a second frequency higher than the first frequency.

3. The pixel of claim 2, wherein the first frequency is greater than 0 Hz and less than 60 Hz, and wherein the second frequency is greater than or equal to 60 Hz.

4. The pixel of claim 2, wherein, when the pixel is driven at the first frequency, the emission bias signal has a low logic level during an emission period of the pixel and has a high logic level during a non-emission period of the pixel.

5. The pixel of claim 4, wherein, when the emission bias signal has the low logic level, the eighth transistor is turned on, and a voltage of the third transistor node is equal to a voltage of the fourth transistor node.

6. The pixel of claim 2, wherein, when the pixel is driven at the second frequency, the emission bias signal has a high logic level.

7. The pixel of claim 2, further comprising:

a fifth transistor including a gate electrode to which an emission signal is applied, a first electrode to which the first power supply voltage is applied, and a second electrode connected to the second node;

a sixth transistor including a gate electrode to which the emission signal is applied, a first electrode connected to the third node, and a second electrode connected to the anode electrode of the organic light emitting diode; and a seventh transistor including a gate electrode to which an anode initialization gate signal is applied, a first electrode connected to the initialization voltage input terminal, and a second electrode connected to the anode electrode of the organic light emitting diode.

8. The pixel of claim 1, wherein the eighth transistor controls the current flowing through the third transistor and the current flowing through the fourth transistor in response to the emission bias signal when a gray level according to the data voltage is a first gray level, and wherein the eighth transistor is turned off when the gray level according to the data voltage is a second gray level lower than the first gray level.

9. The pixel of claim 8, wherein the first gray level is greater than or equal to 127 G, and wherein the second gray level is greater than or equal to 0 G and less than 127 G.

10. The pixel of claim 8, wherein, when the gray level according to the data voltage is the first gray level, the emission bias signal has a low logic level during an emission period of the pixel and has a high logic level during a non-emission period of the pixel.

11. The pixel of claim 10, wherein, when the emission bias signal has the low logic level, the eighth transistor is turned on, and a voltage of the third transistor node is equal to a voltage of the fourth transistor node.

12. An organic light emitting diode display device comprising:

a display panel including a pixel;

a data driver configured to provide a data voltage to the pixel;

a gate driver configured to provide a gate signal to the pixel; and a driving controller configured to control the data driver and the gate driver, wherein the pixel includes:

a first capacitor including a first electrode to which a first power supply voltage is applied and a second electrode connected to a first node;

a first transistor including a gate electrode connected to the first node, a first electrode connected to a second node, and a second electrode connected to a third node;

a second transistor including a gate electrode to which a data write gate signal is applied, a first electrode to which a data voltage is applied, and a second electrode connected to the second node;

a third transistor connected between the first node and the third node, and configured to diode-connect the first transistor in response to the data write gate signal;

a fourth transistor connected between the first node and an initialization voltage input terminal to which an initialization voltage is applied, and configured to transmit the initialization voltage to the first node in response to a data initialization gate signal;

an eighth transistor connected to the third transistor and the fourth transistor, and configured to control a current flowing through the third transistor and a current flowing through the fourth transistor in response to an emission bias signal; and an organic light emitting diode including an anode electrode and a cathode electrode to which a second power supply voltage is applied, wherein the third transistor includes a first sub-transistor and a second sub-transistor which are connected in series between the first node and the third node, wherein the fourth transistor includes a third sub-transistor and a fourth sub-transistor which are connected in series between the first node and the initialization voltage input terminal, and wherein the eighth transistor includes a gate electrode to which the emission bias signal is applied, a first electrode connected to a third transistor node disposed between the first sub-transistor and the second sub-transistor, and a second electrode connected to a fourth transistor node disposed between the third sub-transistor and the fourth sub-transistor.

13. The organic light emitting diode display device of claim 12, wherein the eighth transistor controls the current flowing through the third transistor and the current flowing through the fourth transistor in response to the emission bias signal when the pixel is driven at a first frequency, and wherein the eighth transistor is turned off when the pixel is driven at a second frequency higher than the first frequency.

14. The organic light emitting diode display device of claim 13, wherein the first frequency is greater than 0 Hz and less than 60 Hz, and wherein the second frequency is greater than or equal to 60 Hz.

15. The organic light emitting diode display device of claim 13, wherein, when the pixel is driven at the first frequency, the emission bias signal has a low logic level during an emission period of the pixel and has a high logic level during a non-emission period of the pixel.

16. The organic light emitting diode display device of claim 15, wherein, when the emission bias signal has the low logic level, the eighth transistor is turned on, and a voltage of the third transistor node is equal to a voltage of the fourth transistor node.

17. The organic light emitting diode display device of claim 13, wherein, when the pixel is driven at the second frequency, the emission bias signal has a high logic level.

18. The organic light emitting diode display device of claim 13, wherein the pixel further includes:

a fifth transistor including a gate electrode to which an emission signal is applied, a first electrode to which the first power supply voltage is applied, and a second electrode connected to the second node;

a sixth transistor including a gate electrode to which the emission signal is applied, a first electrode connected to the third node, and a second electrode connected to the anode electrode of the organic light emitting diode; and a seventh transistor including a gate electrode to which an anode initialization gate signal is applied, a first electrode connected to the initialization voltage input terminal, and a second electrode connected to the anode electrode of the organic light emitting diode.

* * * * *